United States Patent [19]

Murphy et al.

[11] Patent Number: 4,472,855

[45] Date of Patent: Sep. 25, 1984

[54] FOLDING SUPPORT FOR A CARPET CLEANING WAND

[76] Inventors: Edward R. Murphy, 25181 SE. 158th St.; Lew E. Plummer, 25210 SE. 159th St., both of Issaquah, Wash. 98027

[21] Appl. No.: 494,851

[22] Filed: May 16, 1983

[51] Int. Cl.[3] ..... A47L 9/00

[52] U.S. Cl. ..... 15/323; 15/321; 15/336; 15/339

[58] Field of Search ..... 15/321, 322, 339, 323, 15/327 C, 336

[56] References Cited

U.S. PATENT DOCUMENTS

| | | | |
|---|---|---|---|
| 2,570,346 | 10/1951 | Hoover | 15/323 X |
| 2,634,451 | 4/1953 | Dow | 15/323 X |
| 3,048,876 | 8/1962 | Kemnitz | 15/321 |
| 3,231,922 | 2/1966 | Smith | 15/339 |
| 4,156,952 | 6/1979 | Lynch | 15/321 X |
| 4,329,756 | 5/1982 | Chicoine et al. | 15/321 |

FOREIGN PATENT DOCUMENTS

| | | | |
|---|---|---|---|
| 1250623 | 12/1960 | France | 15/336 |

*Primary Examiner*—Chris K. Moore

*Attorney, Agent, or Firm*—Delbert J. Barnard

[57] ABSTRACT

An upper mounting portion of a support stand is connected to a carpet cleaning wand between two handles. A lower support leg of the stand is pivotally movable between an in-use position and a stowed position. In its in-use position the lower support leg is in affect an endwise extension of the mount and together with the inlet end of the wand forms a three point support, supporting the wand in an elevated attitude closely approximating the wands in-use attitude. A single spring serves to bias the support leg in both its in-use position and its stowed position.

8 Claims, 4 Drawing Figures

FOLDING SUPPORT FOR A CARPET CLEANING WAND

DESCRIPTION

1. Technical Field

This invention relates to the provision of a means for supporting a carpet cleaning wand in an inclined position, enabling the operator to leave it temporarily during the course of its use without having to lay it down or prop it up against some other article.

2. Background Art

Existing commercial carpet cleaning equipment includes a tubular end attachment for a vacuum hose which is termed a "wand". The wand includes an inlet at one end, an outlet at the opposite end, and handles closely adjacent the outlet end. The operator grasps the handles and uses them for moving the inlet end of the wand back and forth over an area of carpet to be cleaned. A cleaning solution is delivered to the region of the wand inlet, and is injected into the carpet, by conduit means including a section of tubing which extends along the under side of the wand and a hose which delivers the cleaning solution to the tubing. A control valve is positioned between the handles. It includes a control lever which is in easy grasp of the operator.

It is necessary for the operator to frequently release control of the wand and move furniture or reposition the hoses, etc. Many operators merely set the wand down onto the floor when it is necessary to move furniture, etc. It has been found that setting the wand on the floor can frequently cause the cleaning solution deliver system to become damaged. Also, it requires the operator to bend over frequently, both when setting the wand down and when picking it up.

A principal object of the present invention is to provide a quite simple yet effective support stand attachment for a carpet cleaning wand, having an in-use position in which such stand and the inlet end of the wand cooperate to support the wand in a position very closely approximating the in-use position of the wand. The support stand has a stowed position up against the wand. It is easily movable between an in-use position and the stowing position, by the operator applying a force on the stand, swinging it from one position to the other.

DISCLOSURE OF THE INVENTION

A folding support stand for a carpet cleaning wand, constructed according to the present invention, comprises a mounting member which is attachable to the wand at a location which is closer to the outlet end of the wand than to the inlet end of the wand. A pivot means pivotally connects a mounting end of a leg member to the mounting member, for pivotal movement about an axis which extends laterally of the wand. The leg member is pivotally movable between a stowed position in which it extends at an angle to the mounting member and an in-use position in which it extends as an endwise continuation of the mounting member. When in its in-use position, the carpet engaging end of the leg member and the carpet engaging end of the wand support the wand in a slopping position, with its handles within easy grasp and the carpet engaging end in contact with the carpet.

In preferred form, the support leg is held in both its stowed position and in its use position by a single spring. When the support stand is in its in-use position, the spring is oriented to exert a force on one side of the pivot axis, tending to rotate the leg member about the pivot axis and urging end surfaces of the mounting member and the mounting end of the leg member into tight abuting contact. The spring force is easily overcome by the operator exerting a force on the leg member, tending to move it toward the wand. Movement of the leg member swings the spring into a position wherein its line of force is on the opposite side of the pivot axis. When this happens the spring functions to pull the leg member into and then hold it in its stowed position.

Other features of the invention are set forth in the following description of a typical embodiment of the invention in which reference is made to the accompanying drawing.

DESCRIPTION OF THE PREFERRED EMBODIMENT

Figure 1:
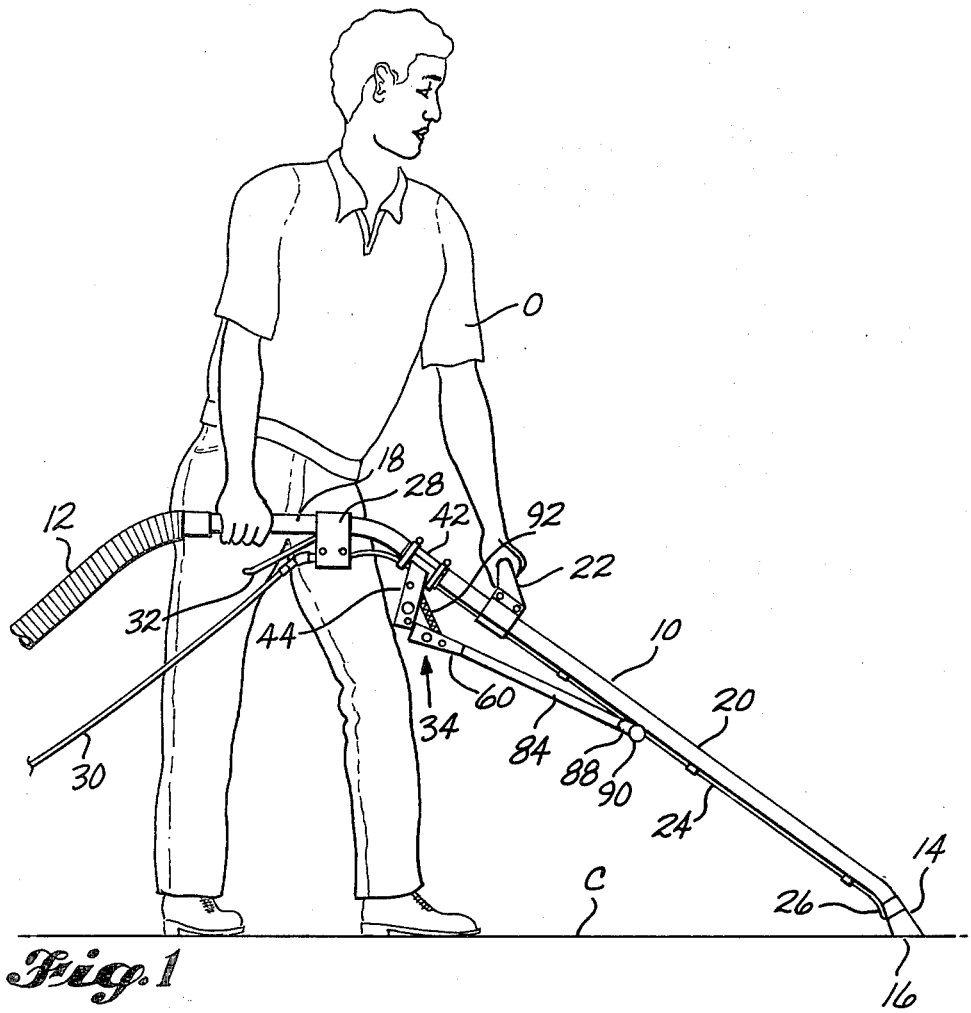
FIG. 1 is a side elevational view of a carpet cleaning wand equipped with a folding stand constructed in accordance with the present invention, such view showing the folding stand in its folded or stowed position and showing the wand in the hands of an operator.

Referring to FIG. 1, the rug cleaning equipment includes a wand 10 having a rear end connection to a flexible vacuum hose 12. The front end 14 of wand 10 includes an inlet 16. As shown, the wand 10 includes a first handle forming straight portion 18 which extends at an angle from an elongated main body portion 20. A second handle 22 is attached to an upper portion of the body 20.

A cleaning fluid delivery line 24 extends along the wand 20 and includes a discharge end 26 positioned adjacent inlet 16. The inlet end of conduit 24 is connected to the outlet of a valve 28. A hose 30 delivers cleaning fluid to the inlet of valve 28. A control lever 32 extends rearwardly from valve 28 into a position below the handle 18. The valve of which lever 32 is a part is biased into a normally closed position. The valve is opened by the operator grasping lever 32 and pulling it up toward the wand handle 18.

The rear end of vacuum hose 12 is connected to a vacuum pump (not shown) which may be mounted within a vehicle. The rear end of hose 30 is connected to a source of cleaning solution which may also be mounted within the vehicle.

In use, the operator grasps handle 22 with one hand and handle 18 with his other hand and proceeds onto a carpeted area to be cleaned. He depresses control handle 32 while sliding the lower end 14 of wand 10 back and forth over the carpet C. Cleaning fluid is directed into the carpet through nozzle 26 and it and dirt from the carpet are sucked up into inlet 16.

Figure 2:
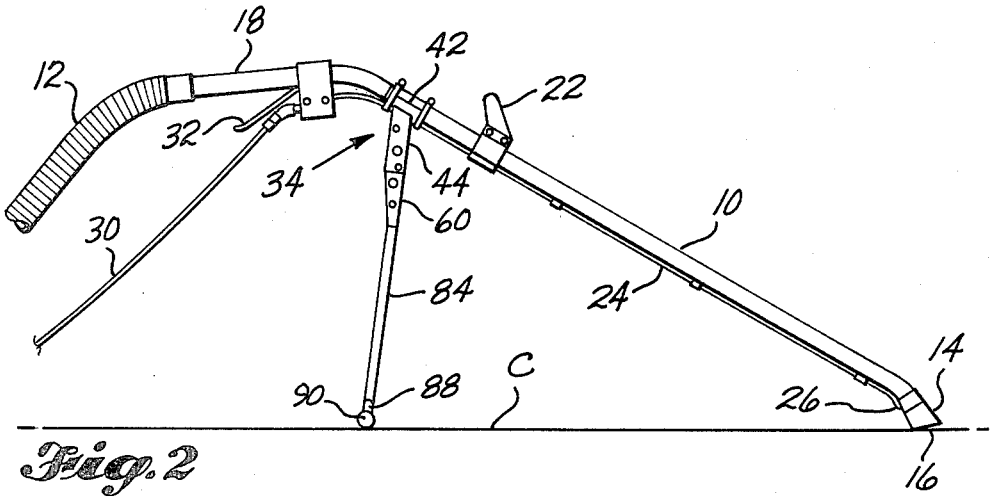
FIG. 2 is a view from the same aspect as FIG. 1, but showing the stand in its in use position, supporting the wand in an elevated position above the carpet.

In accordance with the present invention, the wand 10 is provided with a support stand attachment 34, so that the wand 10 does not have to be set down onto the carpet C but can be supported in an elevated position (FIG. 2).

The attachment 34 comprises a mounting member 36 and a support leg member 38, pivotally attached together for pivotal movement about an axis 40.

Figure 3:
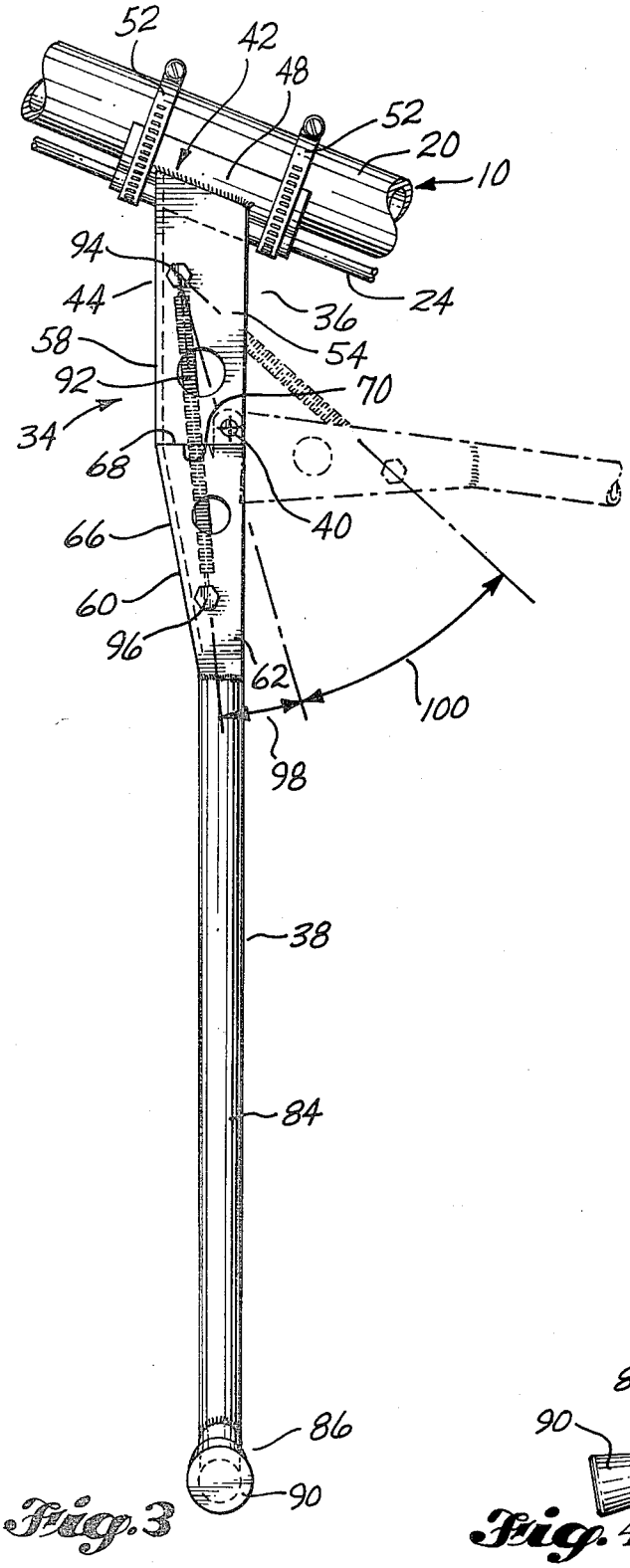
FIG. 3 is an enlarged scale side elevational view of the stand in its in-use position, and including a phantom line showing of a fragment of a lower leg portion of the stand in its stowed position.
Figure 4:
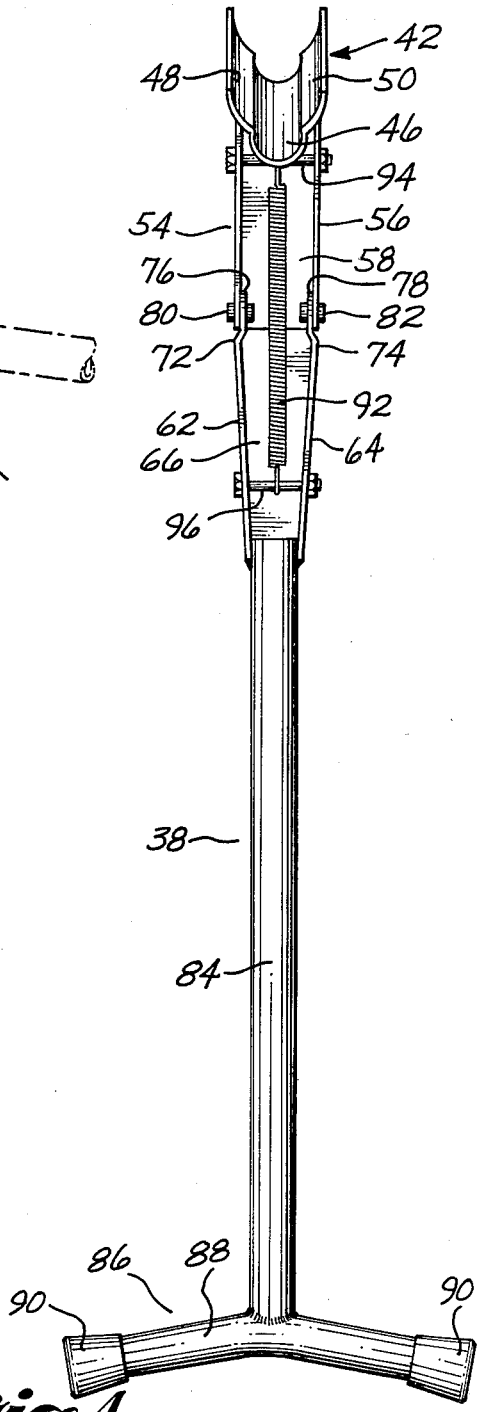
FIG. 4 is an end elevational view of the stand in its in-use position, but detached from the wand, looking toward the face of the stand which in use is directed toward the inlet end of the wand.

Mounting member 36 includes an upper saddle portion 42 and a post portion 44. As best shown by FIG. 4, the saddle portion 42 includes a central channel 46 and side members 48, 50 which are shaped to closely match the curvature of the wand body 20. As shown by FIGS. 1-3, the saddle mount 42 is positioned against a lower portion of wand body 20, between the handles 18, 22, and is held in place by a pair of hose clamps 52. The cleaning fluid delivery conduit 24 extends through channel 46.

In preferred form, the post 44 has a U-shaped cross section. It includes a pair of sidewalls 54, 56 interconnected by a web 58. Post 58 opens toward the carpet engaging end 14 of wand 10. The web 58 is directed toward the operator O.

The support leg 38 includes a channel shaped upper portion 60 having sidewalls 62, 64 and a web 66. The upper end 68 of member 60 conforms in size and shape to the lower end 70 of post 44. Its web 66 is directed toward the operator O. Its open side is directed toward the carpet engaging end 14.

A pair of hinges 72, 74 are attached to member 60. Hinge members 72, 74 preferrably include ear portions 76, 78 which project endwise beyond end surface 68. A pair of hinge pins 80, 82 extend through aligned apertures in the sidewalls 54, 56 and the ears 76, 78 and serve to connect the members 44, 60 together for pivotal movement about the axis 40. Axis 40 extends laterally of the wand 10.

Support leg 38 may include a tubular body 84 which is attached at its upper end to member 60 and carries a foot structure 86 at its lower end. Foot structure 86 may include a tubular cross member 88 of dihedral form, connected at its middle to the lower end of body 84. Elastomeric tips 90 may be provided on the ends of member 88.

The hinge components are positioned to place the pivotal axis adjacent the open side of the assembly 44, 60. A spring 92 is interconnected between upper and lower anchor pins 94, 96, shown in the form of bolts 94, 96 which span between the sidewall pairs 54, 56 and 62, 64, respectively.

As shown by FIG. 3, when the support leg 34 is in its use position, member 60 is in an end-to-end alignment with member 44, the end surfaces 68, 70 make abuting contact, and the spring 92 is located on the operators side of pivot axis 40. Spring 92 exerts a pulling force between mounts 94, 96, tending to rotate member 60 clockwise (as shown in FIG. 3) about the axis 40. Thus, spring 92 functions to hold the surfaces 68, 70 into abuting contact.

When the operator desires to move the support leg 38 into its inoperative or stowed position, he need only exert a force on leg body 84 pushing it toward the end 14 of wand 10. This force overcomes the force of spring 92 and results in leg 38 pivoting in position about axis 40. This action also causes the lower anchor pin 96 to swing in position and relocate the pull line of spring 92 onto the opposite side of the pivot axis 40. As soon as this happens, the spring contracts and functions to both help swing leg 38 up into its stowed position and then holds it in such position. The angular change in direction of the spring force is shown in FIG. 3. When the spring force lies within region 98, it functions to rotate the surfaces 68, 70 relatively together and holds leg 38 in alignment with post 44. When the spring force lies within region 100, it functions to move leg 38 toward, or hold it within, its stowed position. The open sides of the members 44, 60 and the space provided between pivot pins 80, 82 provide an open space through which the spring 92 can move.

When the support leg 38 is in its use position (FIG. 2) the end 14 of wand 10 and the opposite ends of support leg member 88 provide a three point support. The wand assembly is positioned with its handles 18, 22 in easy grasp and the cleaning solution delivery line 30, 28, 24 is in no way stressed.

What is claimed is:

1. A folding support stand for a carpet cleaning wand having a carpet engaging inlet end and an opposite outlet end connectable to a vacuum hose, comprising:

a mounting member attachable to said wand closer to the outlet end than to the inlet end;

a leg member having a mounting end and a floor engaging end;

pivot means pivotally connecting the mounting end of the leg member to the mounting member, for pivotal movement about an axis which extends laterally of the wand, for pivotal movement between a stowed position in which the leg member extends at an angle to the mounting member adjacent a lower portion of the wand, and an in-use position in which the leg member extends as an endwise continuation of the mounting member and functions in conjunction with the carpet engaging end of the wand to support the wand in a sloping position with its carpet engaging end in contact with the carpet; and means for holding the support leg in its stowed position and in its in-use position.

2. A folding support stand according to claim 1, wherein said mounting member includes a saddle having curved surface portions adaptable to fit against a rounded sidewall of a tubular wand, and a post extending downwardly from said saddle.

3. A folding support stand according to claim 2, wherein said saddle includes a central channel portion for receiving a cleaning solution delivery line extending lengthwise below a wand.

4. A folding support stand according to claim 1, wherein the mounting member includes a lower end surface and the mounting end of the leg member includes an upper end surface which makes abutting contact with the lower end surface of the mounting member when the leg member is in its in-use position, and wherein the means for holding the support leg in its stowed position and in its in-use position is a spring having an upper end connected to the mounting member and a lower end connected to the mounting end of the leg member, at connection points so located that when the support stand is in its use position the spring exerts a force positioned on a first side of the pivot axis, tending to pull the end surfaces into abutting contact, said spring being movable upon movement of the leg member towards its stowed position to shift the line of action of the spring over onto the other side of the pivot axis, whereat said spring functions to pull the leg member toward and hold it in its stowed position.

5. A folding support stand according to claim 4, wherein the mounting member and the mounting end of the leg member are both in the form of a channel oriented to open toward the inlet end of the wand, said channel structures providing an open space through which the spring can travel during movement of the leg member between its in-use and stowed position.

6. A folding support stand according to claim 5, wherein the pivot means comprises an ear projecting upwardly from each side of the mounting end of the leg member, and a pair of pivot pins, each extending through apertures in one of the ears and the sidewall of the mounting member, with an open space being left between the pivot pins to accommodate movement of the spring.

7. A folding support stand according to claim 6, wherein the ears and the pivot pin openings and the pivot pins are so positioned to place the pivot axis above the end surfaces of the mounting member and the mounting end of the leg member, toward the rear of the mounting member.

8. A folding support stand according to claim 7, wherein the ends of the springs are connected to support pins which span laterally across the channel shaped mounting member and the channel shaped mounting end of the leg member.

* * * * *